US006420699B1

(12) United States Patent
Herschbach et al.

(10) Patent No.: US 6,420,699 B1
(45) Date of Patent: Jul. 16, 2002

(54) METHOD AND APPARATUS FOR ALTERING THE VELOCITY OF MOLECULES

(75) Inventors: Dudley R. Herschbach, Lincoln; Manish Gupta, Cambridge, both of MA (US)

(73) Assignee: President and Fellows of Harvard College, Cambridge, MA (US)

( * ) Notice: Subject to any disclaimer, the term of this patent is extended or adjusted under 35 U.S.C. 154(b) by 0 days.

(21) Appl. No.: 09/408,064

(22) Filed: Sep. 29, 1999

Related U.S. Application Data

(60) Provisional application No. 60/102,470, filed on Sep. 30, 1998.

(51) Int. Cl.[7] ..... F04B 11/00

(52) U.S. Cl. ..... 250/251; 315/111.11; 315/111.61; 417/49; 415/89

(58) Field of Search ..... 250/251, 423 R, 250/424; 315/111.11, 111.61; 417/49; 415/89

(56) References Cited

U.S. PATENT DOCUMENTS 3,958,899 A * 5/1976 Coleman et al. ..... 417/64

4,611,108 A * 9/1986 Leprince et al. ..... 219/121 PR

OTHER PUBLICATIONS

"Rotor Accelerated Molecular Beams" by Philip B. Moon, Charles T. Rettner and John P. Simons, Chemistry Department, The University, Birmingham B15 2TT.

* cited by examiner

*Primary Examiner*—Bruce Anderson
*Assistant Examiner*—Nikita Wells
(74) *Attorney, Agent, or Firm*—Choate, Hall & Stewart; Sam Pasternack

(57) ABSTRACT

Apparatus for altering translational velocity of molecules in a gas. A source of gas is in fluid communication with a supersonic nozzle. The nozzle is disposed on an arm at a selected distance from an axis for rotation about the axis. The nozzle has an exit portion substantially perpendicular to the arm. Motive apparatus rotates the arm so that the translational velocity of molecules with respect to a laboratory frame of reference is altered. In a preferred embodiment, gas flows from the source through the axis and the arm to exit from the nozzle.

18 Claims, 7 Drawing Sheets

METHOD AND APPARATUS FOR ALTERING THE VELOCITY OF MOLECULES

This application claims benefit of provisional application 60/102,470 filed Sep. 30, 1998.

This invention was supported by NSF Grant No. CHE9529386 and the government has certain rights in the invention.

BACKGROUND OF THE INVENTION

This invention relates to altering the velocity of gaseous molecules utilizing a moving supersonic nozzle.

Many devices and techniques for manipulating neutral atoms or molecules require for their effectiveness that the translational velocity (or kinetic energy) of the particles be markedly reduced. With respect to atoms, the advent of powerful methods for cooling, trapping, and manipulating them with laser light has led to dramatic achievements, including Bose-Einstein condensation of atomic vapor, an atom laser, atom interferometry, and atom lithography. S. Chu, *Rev. Mod Phys.* 70, 685 (1998); C. N. Cohen-Tannoudji, *Rev. Mod. Phys.* 70, 707 (1998); W. D. Phillips, *Rev. Mod. Phys.* 70, 721 (1998). However, many such optical manipulation methods effective for atoms fail for molecules because of the complexity of the energy level structure, with its myriad vibrational and rotational components.

At ordinary temperatures, gas molecules dash about with the speed of rifle bullets. For neutral, unionized molecules, the kinetic energy arising from this thermal motion usually greatly exceeds the interaction energy of feasible external electric or magnetic fields or light fields with the molecules. Thus, while such fields can create an attractive interaction for molecules traversing some spatial region, the molecules cannot be confined there unless much of their kinetic energy is removed.

As an example, an electrostatic storage ring for dipolar molecules has been proposed. D. P. Katz, *J. Chem. Phys.* 107, 8491 (1997). This device, modeled on a neutron storage ring, would employ an inhomogeneous hexapolar toroidal electric field. Within the toroidal ring, molecules with suitably oriented dipoles would follow orbits determined by their rotational state and translational velocity. Design calculations limited to practical parameters indicate that storage lifetimes of the order of $10^3$–$10^4$ seconds might be achieved. However, since the molecular trajectories must bend to stay in the ring, only molecules with low translational kinetic energy can be stored. The same constraint pertains to several other schemes for trapping or manipulating molecules. B. Friedrich and D. Herschbach, *Phys. Rev. Lett.* 74, 4623 (1995); H. J. Loesch, *Chem. Phys.* 207, 427 (1996); T. Seideman, *J. Chem. Phys.* 106, 2881; 107, 10420 (1997); D. R. Herschbach, in *Chemical Research*—2000 *and Beyond: Challenges and Visions,* P. Barkan, Ed. (Am. Chem. Soc., Washington, D.C. and Oxford Univ. Press, New York, 1998), p. 113.

At present there are only a few means by which to produce translationally cold molecules. One method involves the recombination of cold atoms into molecules using either three-body collisions or photoassociation. A. Fioretti, D. Comparat, A. Crublier, 0. Dulieu, F. Masnon-Seeuws, and P. Pillet, *Phys. Rev. Lett.* 80, 4402 (1998). Although this method produces extremely slow molecules (≅300 $\mu$K), the number of molecules at present is very small and the technique is limited to optically accessible, trappable atoms. A more recently demonstrated technique involves the use of time-varying electric field gradients to slow molecules via the force exerted by the transition of the molecule from high to low field. The electric fields must be switched on and off in such a way as to make sure the molecules feel only these transitions. Each such transition removes some kenetic energy from the molecules. A single such transition has been used to further cool cesium atoms liberated from an atom trap. J. Maddi, T. Dinneen, and H. Gould, *Phys. Rev. A.* (in press). A more striking example involved the use of 63 synchronously pulsed electric fields to slow metastable CO molecules from 225 m/s to 98 m/s. H. Bethlem, G. Berden, and G. Meijer, *Phys. Rev. Lett.* 83, 1558 (1999). Only molecules which are in-phase with the time-varying field are slowed (about 1% in the CO case); the rest of the molecules are virtually unaffected. For molecules which do not posses a permanently aligned dipole moment or are initially traveling faster, many more electric fields are required. At present, the most successful technique for cooling molecules is quenching their kenitic energy by collisional relaxation with a cold buffer gas. J. M. Doyle, B. Friedrich, J. Kim, and D. Patterson, *Phys. Rev.* A 52, R525 (1995). This technique has enabled successful trapping of the CaH molecule in a magnetic field. J. D. Weinstein, R. deCarvalho, T. Guillet, B. Friedrich, and J. Doyle, *Nature* 395, 148 (1998). The technique involves using the unusual isotope of helium, $^3$He, maintained by a dilution refrigerator at about 0.24° K. The helium vapor density must be sufficient for collisional quenching. This technology requires that experiments be performed within a cryogenic refrigerator which is a major limitation on flexibility and scope. The cryogenic equipment, as well as provision for recycling the $^3$He vapor, is also quite expensive.

There is therefore a need for method and apparatus that can provide a continuous, high intensity source of molecules slowed to the range of a few meters per second (equivalent to temperatures below 1 Kelvin).

Although the disclosure to follow will be concerned with producing slow molecules, we note that the same device, rotated in the opposite direction, will accelerate the molecules. Since several other good methods are available for generating fast molecule beams, P. B. Moon, Charles T. Rettner, and J. P. Simons, *Faraday Disc.* 77, 630 (1977), we will not expand in detail on this mode. We note that in the accelerator mode the device might find application when it is desired to scan the molecular velocity continuously over a wide range. That mode of operation holds also for the decelerator mode even when the slowing is relatively modest. Our discussion of how to obtain maximal slowing of molecules in the decelerator mode thus implicitly includes these other less demanding operational variants.

SUMMARY OF THE INVENTION

In one aspect, the apparatus according to the invention for altering the translational velocity of molecules in a gas comprises a source of the gas and a supersonic nozzle in fluid communication with the source of gas. As used in this specification, the term "molecule" is defined to include atoms and molecules. Structure is provided for moving the nozzle in a selected direction with respect to molecules emerging from the nozzle. In some embodiments, the structure moves the nozzle in a repetitive fashion, such as with a pendulum. In other embodiments, the supersonic nozzle is disposed on an arm a selected distance from an axis for rotation about the axis. The term arm is used herein to mean any structure that supports the nozzle for rotation about the axis. The nozzle has an exit portion substantially perpendicular to the arm and motive apparatus is provided for rotating the arm such that the translational velocity of the molecules exiting the nozzle is altered. It is preferred that the nozzle be oriented in a direction opposite the tangential velocity of the arm so that the translational velocity of the molecules is reduced. If desired, the nozzle can instead be oriented to increase the translational velocity of the molecules. In one embodiment, the gas flows along the axis and through a hollow arm to the nozzle. Preferably, the angular velocity of the arm is selected so that the tangential velocity of the nozzle is substantially equal to, and opposite from, the velocity of the molecules exiting the nozzle so that their resulting translational velocity (in a laboratory frame of reference) is low, in the range of a few meters per second.

In another aspect of the invention, the rotating nozzle is disposed within a vacuum chamber which may include a mass spectrometer or other means (e.g., fast ion gauge, Doppler shift of a laser induced fluorescence, a toothed wheel velocity analyzer, or other means available in the art) for recording beam molecular intensity as a function of time-of-flight of the molecules from the nozzle to the detector.

Yet another aspect of the invention is a method for altering the translational velocity of molecules in a gas including discharging the gas through a supersonic nozzle while rotating the nozzle about an axis. The rotating step may move the nozzle in a direction opposite to the direction of the gas flow so as to slow down the molecules or the rotation may move the nozzle in the same direction of the gas flow to accelerate the molecules.

The apparatus of the invention thus avoids recourse to expensive cryogenic equipment or lasers while providing a continuous, high intensity source of molecules slowed to the range of a few meters per second which is equivalent to temperatures below 1 Kelvin.

DESCRIPTION OF THE PREFERRED EMBODIMENT

The present invention exploits two venerable techniques, supersonic molecular beams and high speed centrifugal rotation. As will be discussed below, the centrifical rotation significantly enhances the supersonic character of gas flow from a nozzle thereby further narrowing the spread of velocities in the emerging stream of molecules.

Figure 1A:
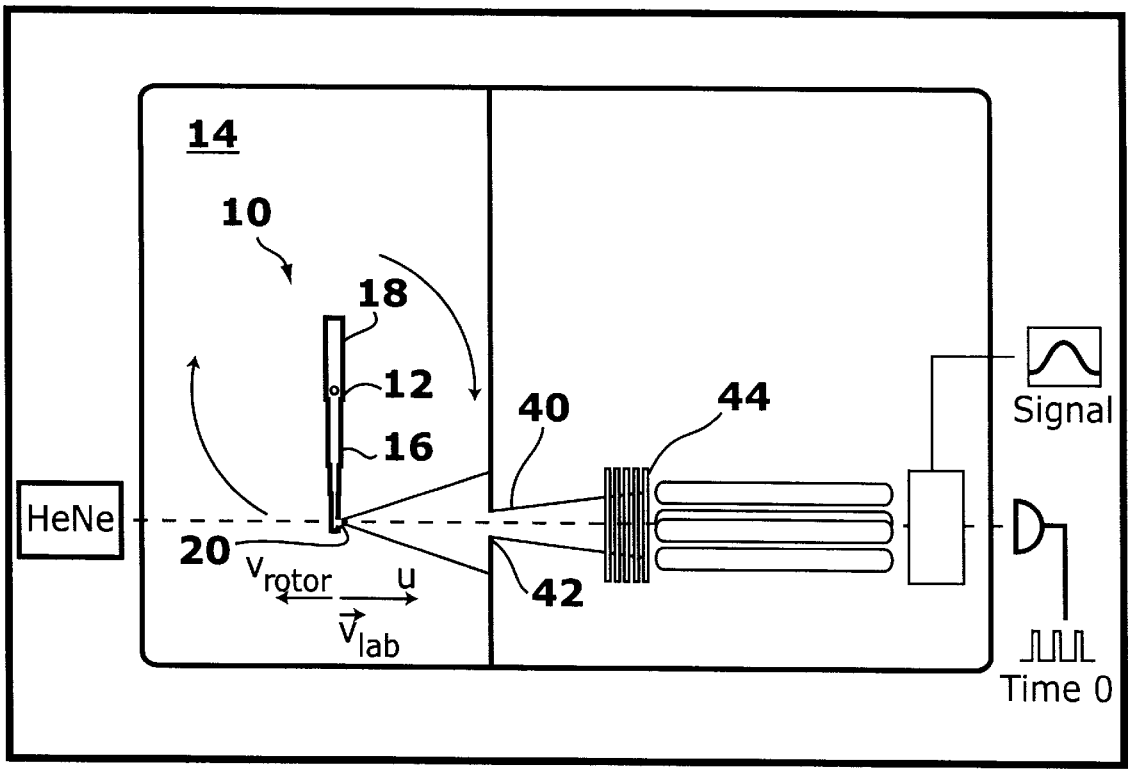
FIG. 1*a* is a schematic view of an embodiment of the invention.
Figure 1B:
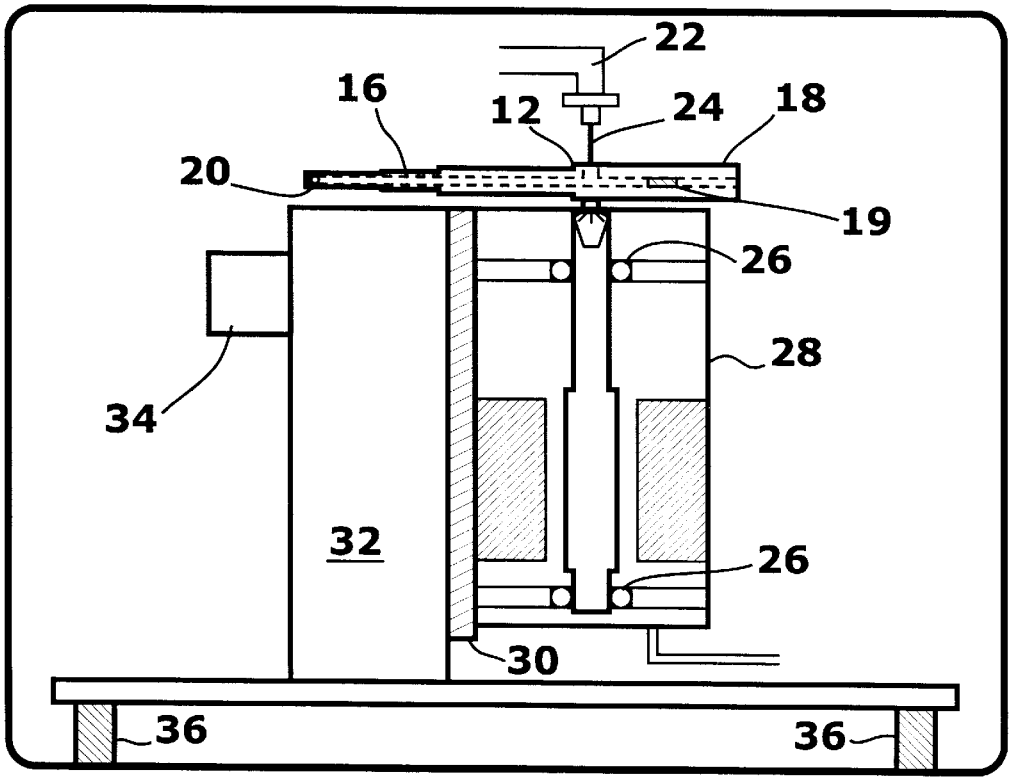
FIG. 1*b* is a side view of the embodiment of FIG. 1*a*.

With reference now to FIGS. 1*a* and 1*b*, an apparatus 10 includes a high speed rotor 12 disposed within a vacuum chamber 14. The rotor 12 includes arms 16 and 18. The arm 18 is provided for balance during rotation and is equipped with a movable set screw 19. The arm 16 includes a supersonic nozzle 20. A source of gas (not shown) enters the apparatus 10 through a gas inlet 22 and is coupled into the rotor 12 through a flexible teflon needle 24. A pair of high speed bearings 26 support the rotor 12. In this embodiment, the arm 16 is hollow allowing gas from the inlet 22 to be in fluid communication with the nozzle 20. A motor 28 drives the rotor 12. The motor is attached to a cooling plate 30 and an inertial block 32. Vibrations are damped by neoprene spacers 36 and measured by an accelerometer 34. As will be appreciated by those skilled in the art, the apparatus illustrated for rotating the rotor 12 is merely exemplary and any other techniques for rotating the rotor 12 at high speed may be utilized. As can be readily seen from FIGS. 1*a* and 1*b*, when spun at a sufficiently high speed in the direction contrary to the emerging molecular beam, the peripheral velocity of the nozzle 20 will almost entirely cancel the velocity of the molecules emitted from the supersonic nozzle 20. If spun in the opposite direction, the rotor instead accelerates the molecules.

With reference still to FIG. 1*a*, a central portion 40 of the emergent molecular beam passes through a nearby slit 42. The beam 40 is detected by a mass spectrometer 44 which records beam intensity as a function of its time-of-flight. In an experimental setup, the motor 28 is capable of reaching approximately 1000 revolutions per second.

If the distance from the axis of rotation to the nozzle 20 is r and the number of rotations per second is ω, the peripheral velocity imparted to the nozzle by the rotor is $$V_{Rotor}=2\Pi r\omega \tag{1}$$

Thus, for the test apparatus in which r=9.906 cm, $V_{Rotor}$ (in meters/sec)=0.62ω (in revolutions/sec). Depending on the direction of rotation, this velocity, $V_{Rotor}$, will be added to or subtracted from the velocity of the beam molecules emerging from the nozzle. The resultant velocity of the molecules traveling to the detector, denoted $V_{Lab}=V_{Beam}\pm V_{Rotor}$, can be derived from the time-of-flight data. (The designation "Lab" indicates that these observable velocities pertain to a frame of reference or coordinate system fixed with respect to the laboratory apparatus.)

Figure 2:
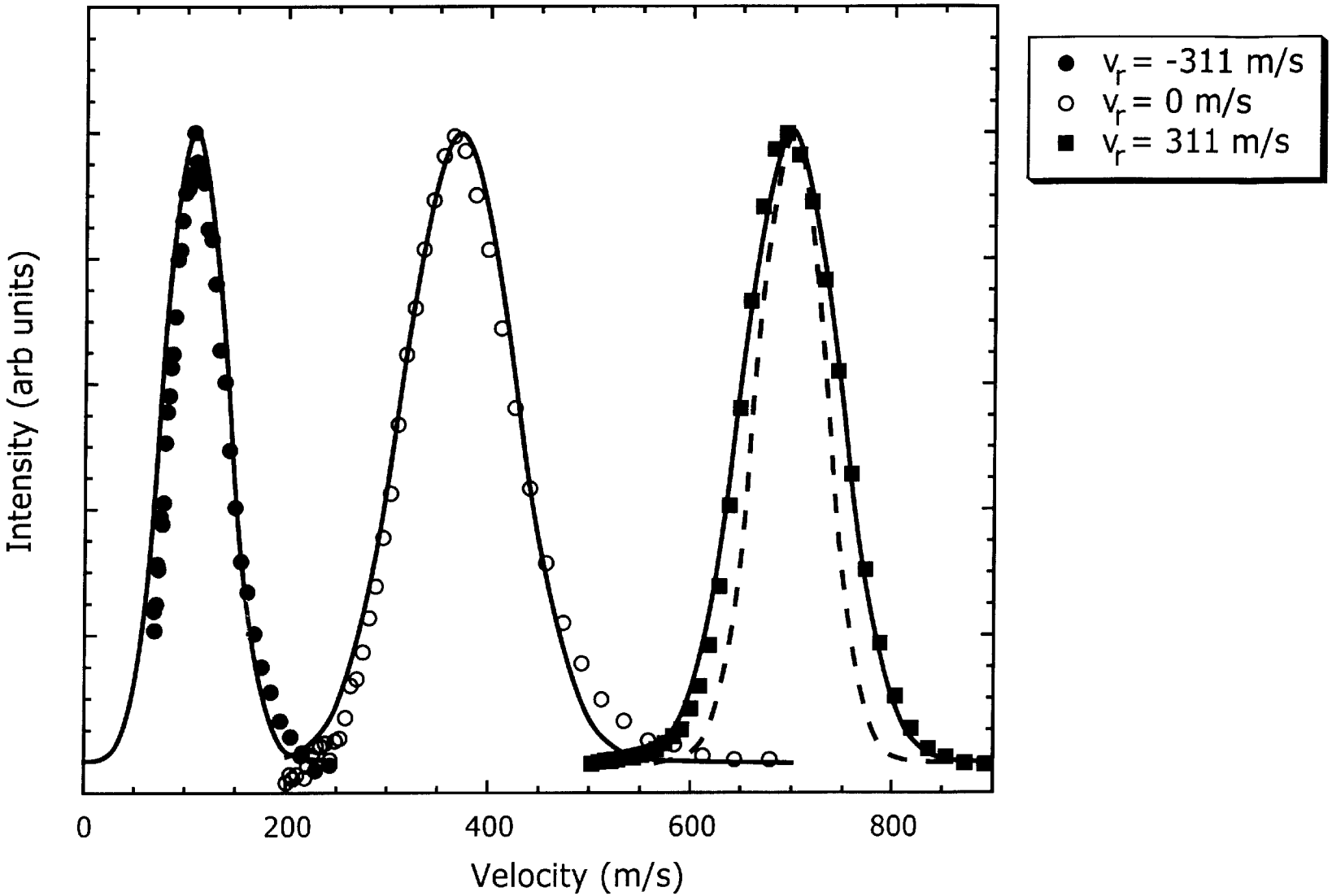
FIG. 2 is a graph of typical test data obtained for a beam of krypton.

With reference now to FIG. 2, this graph shows typical test data obtained for a beam of krypton. Under the conditions of this run, the krypton had a broad thermal distribution of velocities. With the rotor 12 stationary (ω=0) this distribution has a peak intensity at about $V_0$=390 m/s. When the rotor was spun at ω=499 rev/sec, corresponding to $V_{Rotor}$= 311 m/s, the observed velocity distribution was found to shift downwards or upwards by nearly that amount, depending on the direction of rotation.

The test apparatus illustrated in FIGS. 1*a* and 1*b* is far from optimal with respect both to the molecular beam and the spinning rotor. By use of state-of-the-art molecular beam nozzles (and sufficient pumping capacity), it is feasible to produce a much more intense beam, with very narrow spreads in both molecular speeds and directions. Likewise, by using well established techniques for driving high-speed rotors, peripheral velocities exceeding 1000 m/sec can be attained. In what follows, we discuss the invention with respect to existing techniques and present design calculations for further embodiments of the invention.

When a gas expands into a vacuum through a pinhole nozzle, the pressure and temperature both drop abruptly. The nozzle imposes collisional communication that brings the gas molecules to nearly the same speed and roughly the same direction. It also efficiently relaxes thermal excitation of molecular rotation and (less so) vibration. Thus, not only is the intensity of a supersonic beam far higher than that from an ordinary effusive source, but the spreads in speed, direction, and rotational tumbling are markedly narrowed. D. R. Miller, in *Atomic and Molecular Beam Methods,* Vol. I., G. Scoles, Ed. (Oxford Univ. Press, New York, 1988), p. 14. The distribution of velocities in such a beam has the form $$P(v)=v^2\exp\{-(v-u)/\Delta v\}^2 \quad (2)$$

aside from a normalization constant. Here u is the mean flow velocity and Δv the velocity spread, given by $$u=128\{[\gamma/(\gamma-1)][T_o/m]\}^{1/2}[1-(T/T_o)]^{1/2} \quad (3)$$

$$\Delta v=128(T/m)^{1/2} \quad (4)$$

where the velocities are in units of meters/sec, m denotes the molecular mass, in grams/mole, $\gamma=C_p/C_v$ is the ratio of specific heats for the gas at constant pressure and volume, $T_o$ and T are the gas temperatures in degrees Kelvin before and after expansion through the nozzle. For the conditions of interest here (expansions at high Mach numbers), to a good approximation, G. M. McClelland, K. L. Saenger, J. J. Valentini, and D. R. Herschbach, *J. Phys. Chem.* 83, 947 (1979)

$$T/T_o=A(T_o/P_oD)^{\alpha} \quad (5)$$

where $P_o$ is the pressure (in Torr) behind the nozzle, D is the nozzle diameter (in cm), A is a somewhat elaborate function of γ and $\alpha=2(\gamma-1)/\gamma$.

The temperature T here pertains to the translational velocity spread in the direction of the molecular trajectories well downstream of the nozzle exit, where collisions within the beam no longer occur. In more detailed analyses of supersonic flow, H. C. W. Beijerinck and N. R. Verster, *Physica* 111C, 327 (1981), a temperature pertaining to transverse velocity components is also defined. However, in the far downstream region (many nozzle diameters from the exit) pertinent here, this transverse temperature is much below T and need not be separately considered. Also of interest is the temperature $T_{rot}$ characterizing the population of molecular rotational states, C. E. Klots, *J. Chem. Phys.* 72, 192 (1979); for the strong expansions we consider, this is practically equal to T. For most applications in which molecules with low translational velocity are desired, low $T_{rot}$ is also advantageous.

Figure 3:
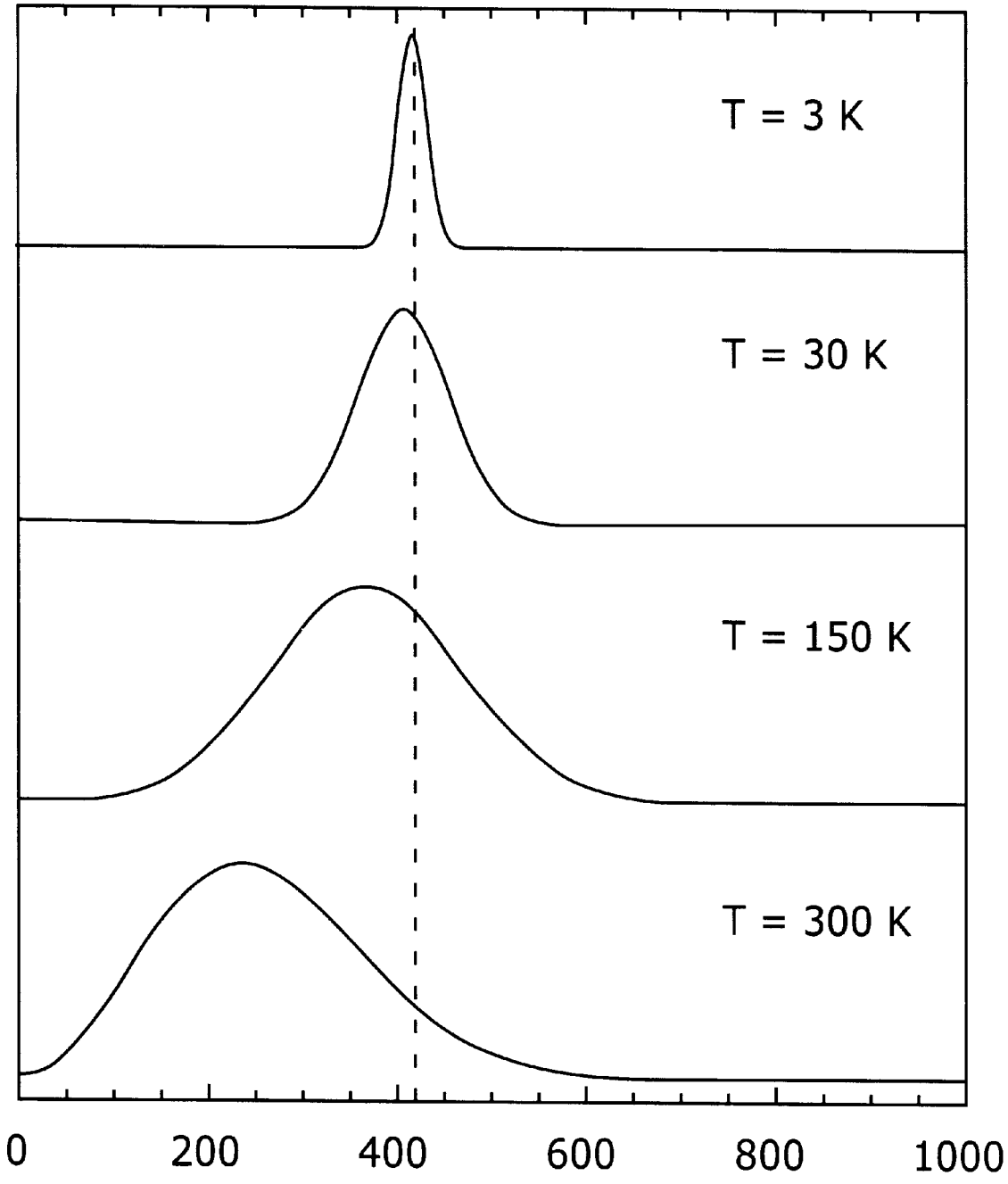
FIG. 3 is a graph illustrating that velocity distribution becomes more and more narrow for increasingly strong expansions.

FIG. 3 illustrates how, for increasingly strong expansions (increasingly large $P_oD$), T drops further and further below $T_o$ and the velocity distribution becomes more and more narrow. Eventually it becomes simply a "spike distribution" of width Δv centered on u, the mean flow velocity. The curves shown, computed from Eq.(2), all pertain to $T_o$=300 K; for the lowest curve, with $T=T_o$ and u=0, the distribution is that for an effusive molecular beam; it is not supersonic, since $P_oD$ is low enough to allow molecules to emerge from the nozzle without suffering collisions. (In our test run shown in FIG. 2, the beam was only slightly supersonic, as our pumping capacity did not allow use of a large value of $P_oD$. Also, the fact that at the peak of the velocity distributions the observed shifts are about 10 m/sec less than $V_{Rotor}$ is attributable to averaging over the angular dispersion of an effusive beam, which allows molecules from a corresponding range of rotor positions to reach the detector, an effect that will diminish markedly when a supersonic beam is used.)

Figure 4:
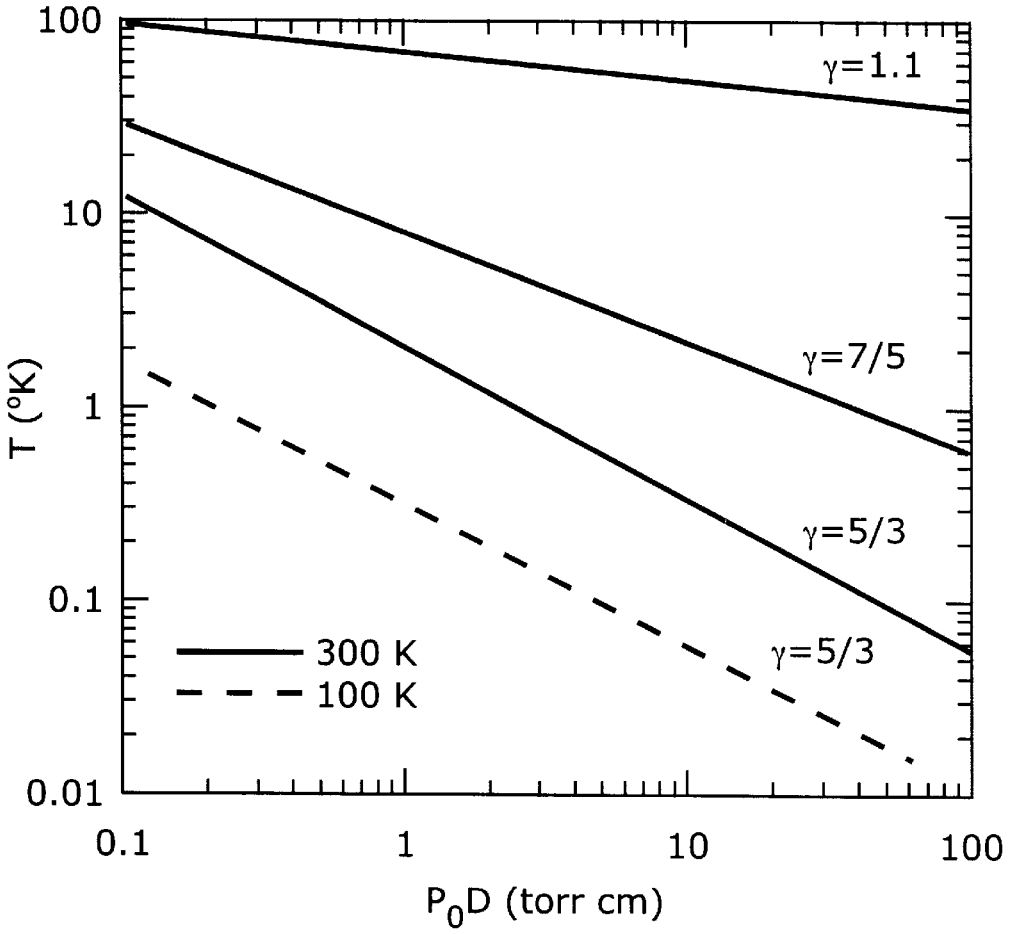
FIG. 4 is a graph illustrating how temperature varies with expansion parameter for values of specific heat ratio.

FIG. 4 shows how T varies with the key expansion parameter $P_oD$, for a fixed $T_o$=300 K and three values of the specific heat ratio γ=5/3, 7/5, and 1.1, values appropriate for a gas of atoms, diatomic molecules, or large polyatomic molecules, respectively. A plot for $T_o$=100 K (dashed line) is included to illustrate that such a threefold drop in the temperature of the gas behind the nozzle lowers the final T by about a factor of 10.

Figure 5:
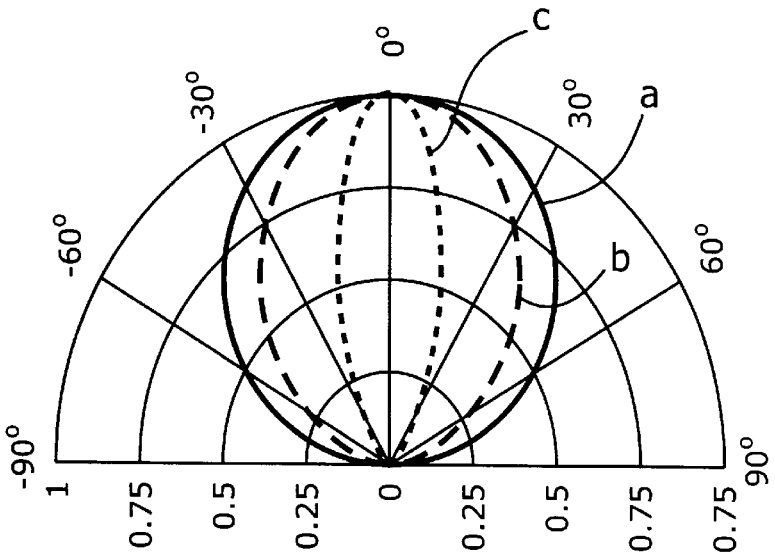
FIG. 5 is a polar plot comparing intensity distribution of molecules from an effusive source, a sonic nozzle and a supersonic nozzle.

FIG. 5 illustrates how a marked narrowing of the angular spread in the emerging molecular beam can be attained by means of a suitable supersonic nozzle. A polar plot is shown, comparing the intensity distribution of molecules from (a) an effusive source with that from (b) a sonic nozzle and from (c) a supersonic (or "Laval") nozzle for which the ratio of throat-to-exit diameter is four. H. C. W. Beijerinck and N. R. Verster, *Physica* 111C, 327 (1981). For instance, in (a), the intensity at a direction ±60° from the centerline of the beam is 50% of that at the centerline (0°), whereas in (c) by ±12° the intensity has already fallen to 50% of that along the centerline. The angular spread is characterized by a quantity termed the "peaking factor," and denoted by κ. It is defined, Beijerinck and Verster, supra, as $\kappa=\pi I(0°)/I_{Tot}$, where I(0°) is the intensity at the centerline and $I_{Tot}$ the total rate of flow (molecules/sec) from the source; the factor of π is included so that κ=1 for an effusive source. For the examples (a,b,c) of FIG. 5 the peaking factors are κ=1, 2, and 15, respectively. It is important that the source have a high peaking factor, since only molecules directed fairly close to the beam centerline will have $V_{Lab}=V_{Beam}-V_{Rotor}$ small.

Figure 6:
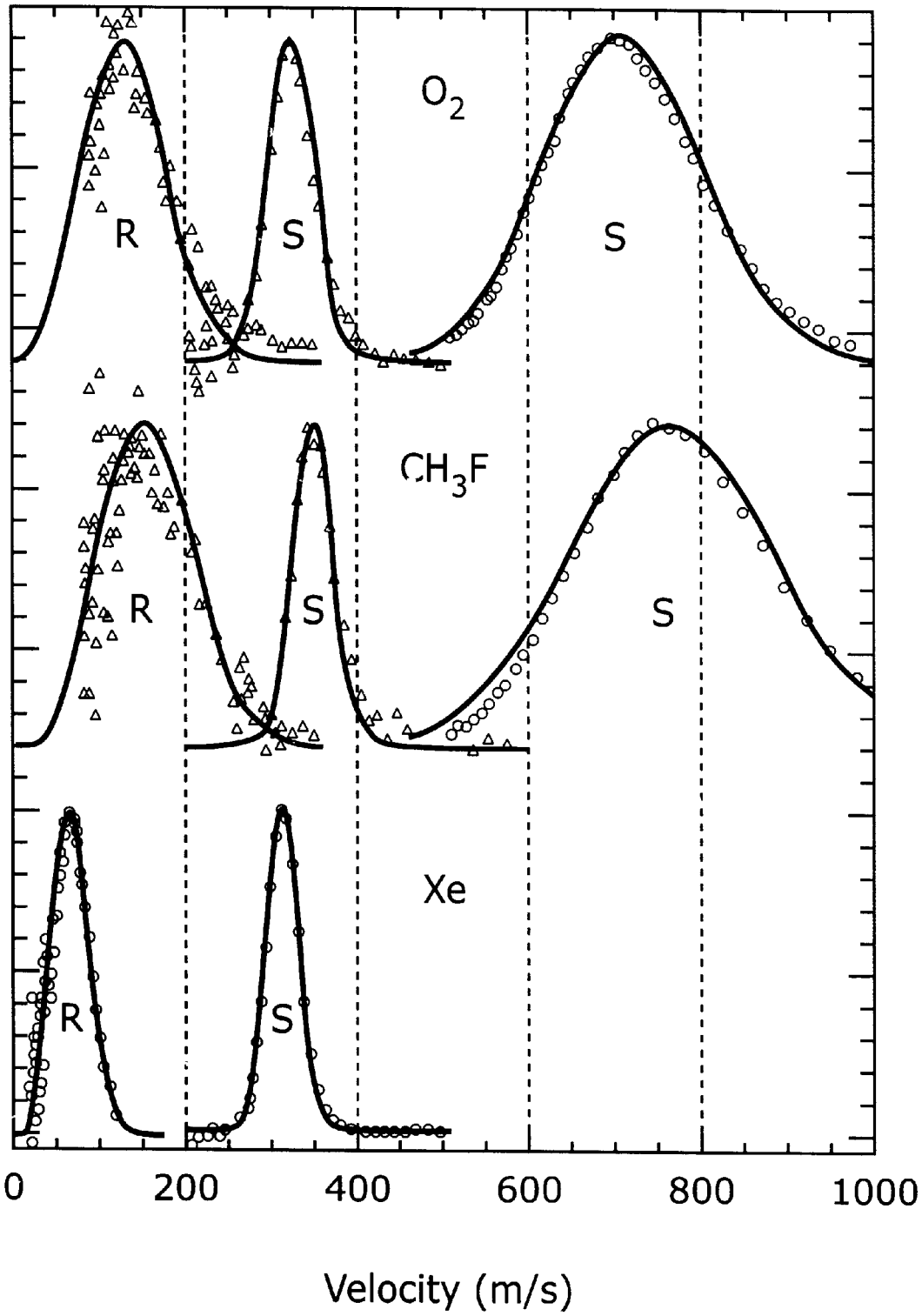
FIG. 6 is a graph showing an example of inverse seeding.

Another widely exploited aspect of supersonic beams can be utilized in the rotor system. These techniques, known as "seeding" and "inverse seeding", involve mixing a small amount (usually less than 5%) of the molecule of interest with a diluent gas. In the case of "seeding", the diluent is lighter than the molecule and the molecule is accelerated to the flow velocity of the diluent. For "inverse seeding", the molecule is lighter than the diluent, and the molecule is decelerated to the flow velocity of the diluent. In either case, the mixture adopts the γ of the diluent which is usually the maximal value of 5/3. Also, often the diluent gas can provide a much higher $P_oD$ value than would be feasible for the molecule alone. Both of these effects permit the molecules to be cooled very efficiently in the molecular beam. For example, with He as diluent, a benzene beam has been produced, S. M. Beck, M. G. Liverman, D. L. Monts, and R. F. Smalley, *J. Chem. Phys.* 70, 232 (1979), with very low internal kinetic energy and rotational temperature, only *T*=0.3 K. "Seeding" is advantageous because the heavier molecules get focused along the center of the molecular beam, however, the molecules are accelerated, requiring the rotor to spin faster to slow then down. Likewise, "inverse seeding" slows the molecules and requires a smaller rotor speed, but reduces the number of molecules along the beam axis. Both techniques suffer from lower intensities due to the small seeding fractions. FIG. 6 shows an example of "inverse seeding" for $O_2$ in Xe and $CH_3F$ in Xe with and without the rotor spinning. The bottom panel shows the rotor induced slowing of pure xenon.

Techniques for high-speed rotation have long been extensively developed for a variety of centrifugal applications. J. W. Beams, *Rev. Mod. Phys.* 10, 245 (1938). Rotor accelerated molecular beams have also been produced, by two methods. P. B. Moon, Charles T. Rettner, and J. P. Simons, *Faraday Disc.* 77, 630 (1977) and P. B. Moon, *Proc. Ray. Soc. Lond* A360, 303 (1978). (I) In the method chiefly used, beam molecules are swept up by the rotor as it spins in a gas at low pressure or as the rotor tip crosses a localized jet of gas. The molecules gain velocity either by being swatted by the rotor or by evaporating from the spinning tip. (II) In the other method, seldom used, the beam material is deposited on or attached to the tip in solid form before the rotor is spun and later evaporated off by resistive heating of the rotor. The possibility of mounting a gas source on the rotor, as in the present invention, was mentioned by Moon. However, he did not pursue that, or consider use of a rotating supersonic nozzle, since he was interested only in accelerating molecules and regarded such a method to be much less tractable than method (I) above.

Figure 7:
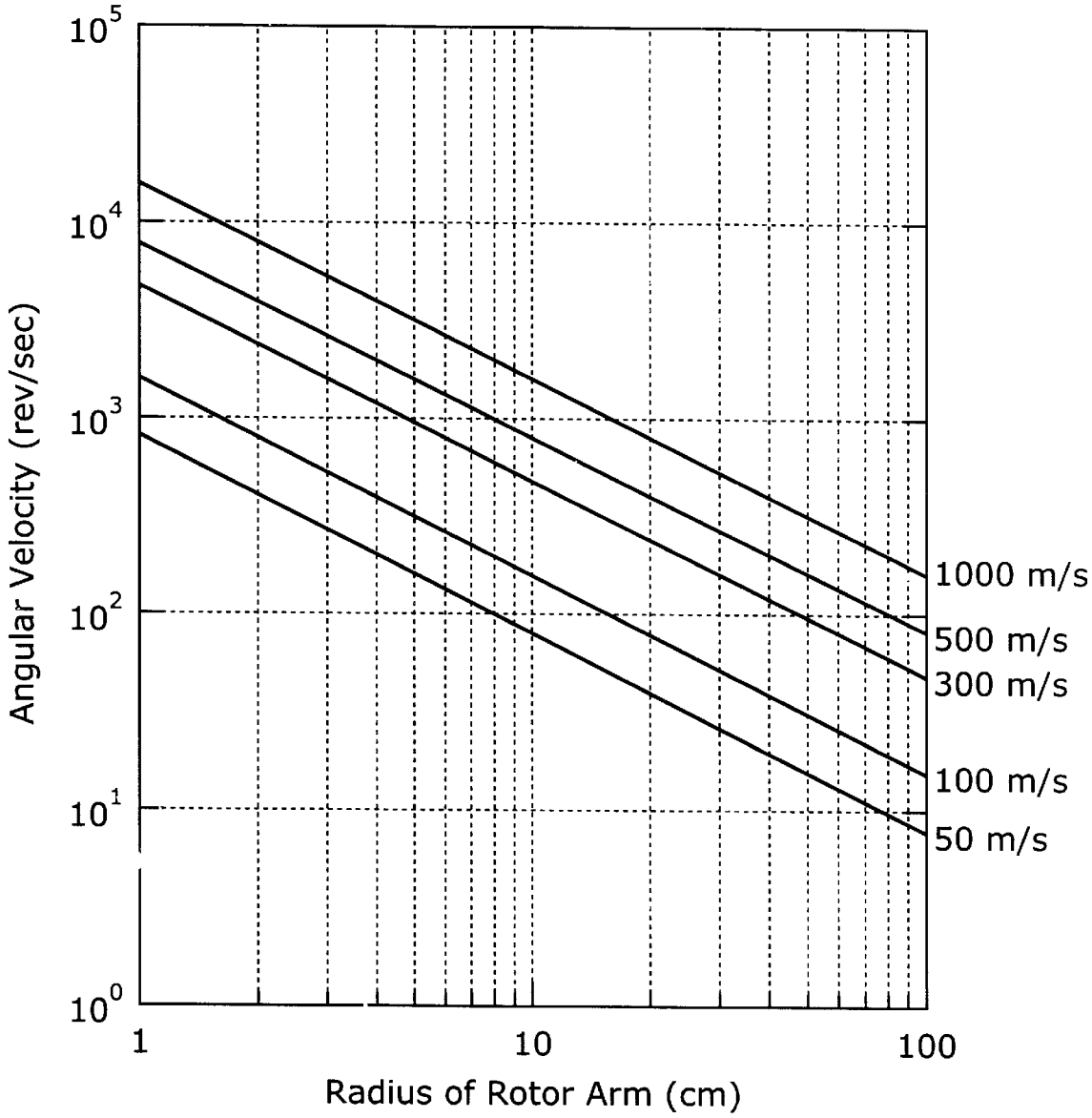
FIG. 7 is a nomogram relating angular velocity, peripheral velocity and rotor arm radius.

For our application, we are primarily interested in attaining peripheral velocities $V_{Rotor}$ in the range 200 to 1000 m/sec, which spans the range of flow velocities attained in supersonic molecular beams for typical molecular masses and source temperatures. FIG. 7 presents a nomogram corresponding to Eq.(1), displaying for various values of $V_{Rotor}$ the wide range in choices of the rotor arm r and angular velocity ω that could be used. The choice of r will also depend on the size and configuration of an auxiliary device, such as the storage ring, to which the molecules with slow $V_{Lab}$ are to be delivered. To generate high angular velocities ω, there are at least three preferred options: (1) A fast motor-driven spindle, Precision Drive Systems, Dallas, N.C. (personal communication, 1998) (used for high-speed drilling of electronic circuit boards); used with high-speed bearings, it can go up to somewhat above ω=1000 revs/sec. (2) A fluted cone driven by compressed air, and of course located outside the vacuum system. J. W. Beams and E. G. Pickels, *Rev. Sci Inst.* 6, 299 (1935). It would carry a tube that passes into the vacuum chamber via a special seal and both supports the rotor and supplies the nozzle with the feed gas. Such a system has long been used in centrifuges, and can readily go up above ω=2000 revs/sec. (3) Levitation of the rotor by a suspending electromagnet within the vacuum chamber, with the driving torque supplied by a rotating magnetic field supplied by surrounding coils. Moon, supra. Such systems have been routinely operated up to and above ω=3000 revs/sec.

The simplest option to implement is (1); by using it with r up to 10 cm (4 inches), the corresponding $V_{Rotor}$ can cancel flow velocities up to about 625 m/sec. From Eq.(3), for $T_o$=300 K, we find that this would suffice for pure beams of molecules heavier than about 40 amu, or virtually any species seeded in argon (the most commonly used and least expensive diluent gas).

In order to harvest the molecules produced with slow $V_{Lab}$, it is essential that those molecules escape from the path of the rotor arm before it swings around and swats them. The time required for this escape is inversely proportional to $V_{Lab}$, and the time available for it is inversely proportional to ω, the rotor frequency. For the conditions of our test run in FIG. 2, this swatting is insignificant. There ω is low enough and, for practically all the molecules, $V_{Lab}$ is high enough to enable them to move beyond the rotor path and travel undisturbed toward the detector. Fortunately, even for very slow $V_{Lab}$ and fast ω, much of the swatting can be avoided by simply aiming the nozzle so the beam centerline is directed slightly below the plane in which the rotor arm whirls (designated the x-y plane). Thereby the molecules will acquire a velocity component downwards (designated the z-direction, with its coordinate axis perpendicular to the x-y plane). It is useful to have this $V_z$ component anyhow, provided it is not too large, since it will serve to carry the molecules to a collection device, such as a storage ring, focusing field, or trapping region.

If the nozzle centerline is aimed at an angle a below the x-y plane, the optimal cancellation condition becomes $V_{Rotor}$=ucosα and the downwards velocity component is $V_z$=usinα. For ω=1000 revs/sec (option 1 above) the escape time available is $10_{-3}$ sec. Thus, even a small downward component, say $V_z$=5 m/sec, suffices to carry a molecule a safe distance away, 5 mm, before the next cycle of the rotor arm. (Note that for a two-bladed rotor like that in FIG. 1, the blade tip without the nozzle can be notched or shaped so that it will not perform swatting.) Accordingly, we find the angle α=arcsin($V_z$/u) can be quite small, about a degree or less for the range u=250–600 m/sec of most interest.

Centrifugal action can significantly enhance the supersonic character of the gas flow from the nozzle. Under our conditions, the "leak" out the pinhole nozzle is small enough so the gas within can be regarded as in thermal equilibrium. The density ρ of the gas at the tip of the rotor is then larger than the density $\rho_o$ of that entering along the axis of rotation by an exponential factor, J. W. Beams, *Rev. Mod Phys.* 10, 245 (1938).

$$\rho=\rho_o\exp[-mV^2/(2RT_o)]=\rho_o\exp[-2\pi^2mr^2\omega^2/RT_o] \quad (6)$$

where m is the molecular mass, $T_o$ the temperature within the hollow arm and V the peripheral velocity. (This relation is the basis for isotope separation in gaseous centrifuges.)

Figure 8:
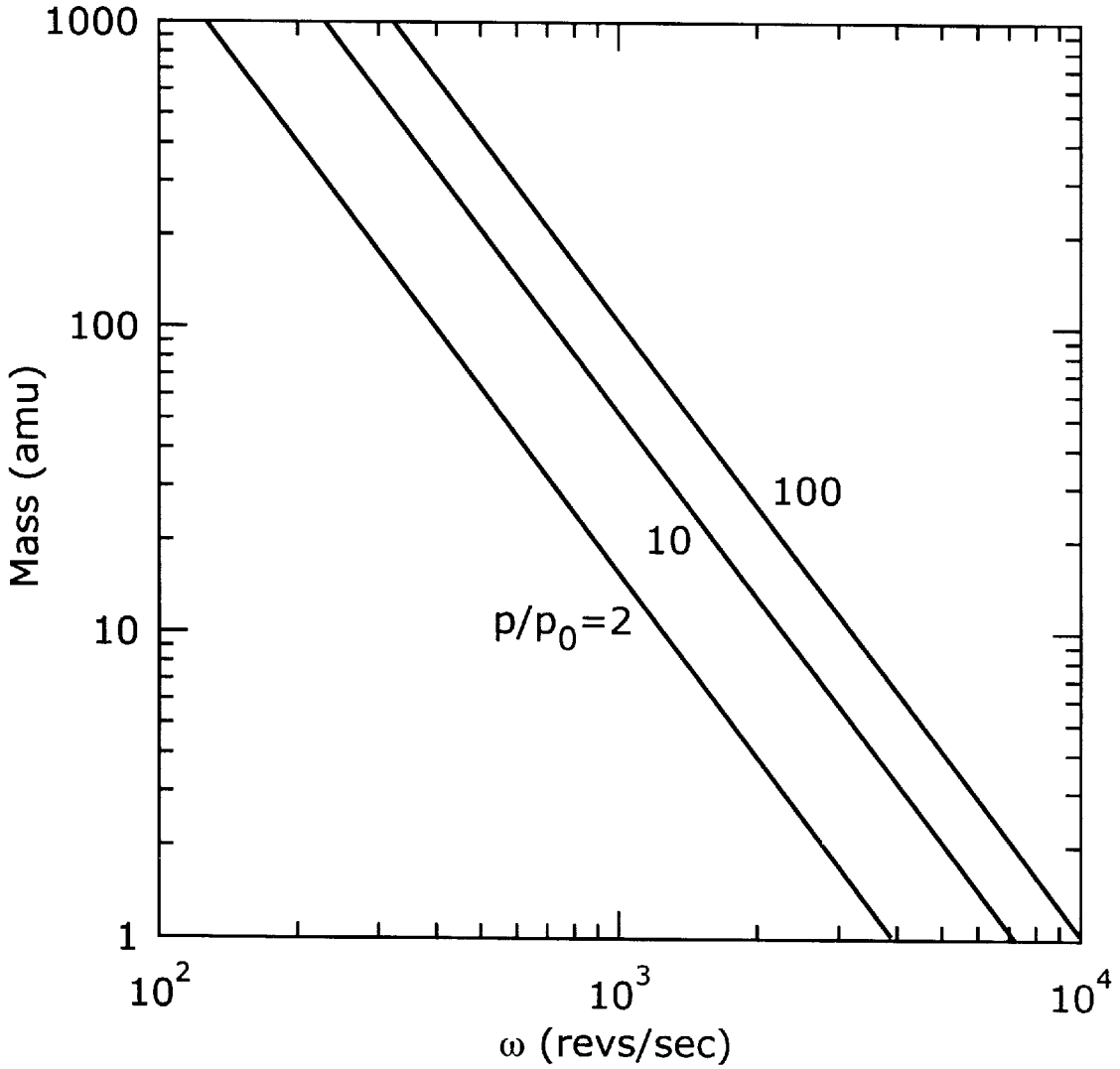
FIG. 8 is a nomogram relating the centrifugal enhancement of gas density to the molecular mass and the angular frequency of the rotor.

FIG. 8 displays Eq.(6) in nomogram form. It enables $\rho/\rho_o$ to be read off for various values of m and ω. Although the $\rho/\rho_o$ loci shown pertain to $T_o$=300 K and r=7.5 cm, the plot is useful for any temperature or radius. That holds since, as evident in Eq.(6), decreasing $T_o$ by some factor is equivalent to increasing m by the same factor, whereas decreasing r by some factor is equivalent to decreasing ω by the same factor. Even for molecules that are not especially heavy, the density enhancement can easily become very large. For instance, for m=100 amu at ω=1000 revs/sec the ratio $\rho/\rho_o$ is about 100. That is equivalent to increasing the pressure $P_o$ behind the nozzle by 100. As seen from FIG. 4, for a diatomic molecule (γ=7/5), such a pressure increase would lower the final kinetic temperature of the emerging gas by more than a factor of 10.

For a rotor deceleration apparatus, there are six key experimental variables that govern the production of slow molecules: nozzle diameter D and peaking factor κ; pressure $P_o$ and temperature $T_o$ behind the nozzle; rotor arm radius r and angular frequency ω. Once constructed, a particular apparatus will have fixed values of, D, κ, r; and it will be operated at a fixed $T_o$, whereas in individual runs $P_o$ and ω will be adjusted to attain optimum results.

Pertinent molecular properties include: the heat capacity ratio γ and vapor pressure at $T_o$; and molecular mass m. Other properties enter if the slow molecules produced are to interact with an external electric or magnetic field: the magnitude of the electric or magnetic dipole moments and the moments of inertia; or if to interact with a laser field: the polarizability and its anisotropy, which governs the induced electric dipole moment.

For a given molecular species, the narrowest velocity spreads will be attained using the largest feasible value of $P_oD$ (as seen in FIG. 4). It is advantageous to obtain that with a large $P_o$ and small D. Thereby the total flow rate $I_{Tot}$, which is proportional to $P_oD^2$, can be kept from becoming larger than can be handled by the available pumping capacity. This is important, since the ambient pressure of background gas in any region traversed by the slow molecules must be low in order to avoid attenuating the yield by collisions with background gas. Estimates by standard methods indicate the background pressure needs to be kept below about $5\times10^{-5}$ torr if the distance traversed is as much as 5 centimeters. As noted above, the centrifugal density enhancement (FIG. 8), will usually increase $P_o$ significantly, so it is feasible and desirable to use an unusually small D for the nozzle in the rotor deceleration apparatus.

It is preferable to use the longest feasible rotor arm radius r. That enables ω to be proportionally lower (FIG. 7) and enlarges the accessible range of peripheral velocities. For different purposes, values from perhaps r=5 to 50 cm might be employed. As noted above, the choice of r will usually be made to mesh with an auxiliary collection device.

For instance, if the slow molecules are to be "loaded" into an electrostatic storage ring, D. P. Katz, *J. Chem. Phys.* 107, 8491 (1997), a likely configuration would be to locate the ring in a plane parallel to and below the plane of the rotor, and to make r equal to the radius of the ring. Then the slow molecules that emerge from the nozzle (with a small $V_z$ component downwards) would "rain down" into the storage ring from all points on the 360° rotor path. This would enable the largest possible fraction of the total molecular flux, $I_{Tot}$, to be deposited in the ring. (In contrast, our test apparatus of FIG. 1 allows only a tiny fraction to reach the detector, namely only those molecules emitted from the nozzle when the rotor arm reaches a particular very narrow range of angular positions.) The recently proposed storage ring has a radius of 50 cm, but smaller rings will become feasible if our invention supplies a good yield of very slow molecules.

For our present design calculations, we limit consideration to parameter values comfortably within the range of current experimental practice. These serve to define a "standard model" of the apparatus and its operating conditions. For this we consider a nozzle with D=0.010 cm and κ=15, operated at $T_o$=300 K with expansions strong enough to give T=3 K, and a rotor with r=7.5 cm operated at speeds up to ω=1000 revs/sec.

In conclusion, we note again that here we have confined our discussion almost solely to how our invention can provide slow molecules, for the purpose of supplying or enhancing storage rings, focusing fields, and other devices designed to manipulate trajectories of uncharged molecules. However, there are other applications in which it is desired to obtain a low velocity (or kinetic energy) associated with the relative motion of interacting molecules. In such applications, the individual molecules do not necessarily need to be moving slowly. Rather, it is necessary to have a means to tune precisely the velocity of one species to nearly match that of another. A prototype arrangement would employ a conventional, stationary supersonic beam of species A and use our rotating supersonic source to generate a beam of species B, aimed to cross the stationary beam at a slight, grazing angle. For each beam the velocity spreads, $\Delta v_A$ and $\Delta v_B$, would be quite narrow, and since the intersection zone would be stationary, collimating slits could be used as usual to ensure narrow angular spreads, $\Delta\theta_A$ and $\Delta\theta_B$, for the interacting beams. Then by varying the rotor frequency, the flow velocity of B could be scanned from below, to matching, to above the velocity of A, thereby probing the dependence of the interaction on the relative collision velocity.

Modifications and variations of the invention will be apparent to those skilled in the art and it is intended at all such modifications and variations be included within the appended claims.

What is claimed is:

1. Apparatus for altering the translational velocity of molecules in a gas comprising:

a source of gas;

a nozzle in fluid communication with the source of gas; and structure for moving the nozzle in a selected direction with respect to molecules emerging from the nozzle.

2. The apparatus of claim 1 wherein the structure moves the nozzle in a repetitive fashion.

3. The apparatus of claim 1 further including pulse means for discharging molecules through the nozzle at peak velocity of the pendulum.

4. Apparatus for altering the translational velocity of molecules in a gas comprising:

a source of gas;

a supersonic nozzle in fluid communication with the source of gas, the nozzle disposed on an arm a selected distance from an axis for rotation about the axis, the nozzle having an exit portion substantially perpendicular to the arm; and motive apparatus for rotating the arm whereby translational velocity of molecules in the gas is altered.

5. The apparatus of claim 4 wherein the translational velocity is reduced.

6. The apparatus of claim 4 wherein the translational velocity is increased.

7. The apparatus of claim 4 wherein the gas flows along the axis and through the arm to the nozzle.

8. The apparatus of claim 5 wherein angular velocity of the arm is selected so that the peripheral velocity of the nozzle is substantially equal and opposite to the velocity of the molecules exiting the nozzle.

9. Apparatus for altering the translational velocity of molecules in a gas comprising:

a source of gas;

a vacuum chamber;

a supersonic nozzle located within the vacuum chamber and in fluid communication with the source of gas, the nozzle disposed on an arm a selected distance from an axis for rotation about the axis, the nozzle having an exit portion substantially perpendicular to the arm; and motive apparatus for rotating the arm whereby translation velocity of molecules in the gas is altered.

10. The apparatus of claim 9 further including a means disposed within the vacuum chamber for detecting beam intensity as a function of time-of-flight of the molecules from the nozzle to the gauge.

11. The apparatus of claim 10 wherein the means for detecting beam intensity comprises a fast ion gauge.

12. The apparatus of claim 10 wherein the means for detecting beam intensity comprises an apparatus for detecting Doppler shift of laser fluorescence.

13. The apparatus of claim 10 wherein the means for detecting beam intensity comprises a toothed wheel velocity analyzer.

14. Method for altering the translational velocity of molecules in a gas comprising:

discharging the gas through a supersonic nozzle while rotating the nozzle about an axis.

15. The method of claim 14 wherein the rotating step moves the nozzle in a direction opposite the direction of the gas leaving the nozzle.

16. The method of claim 14 wherein the rotating step moves the nozzle in the same direction as the gas leaving the nozzle.

17. Apparatus for altering the translational velocity of molecules in a gas comprising:

a supersonic nozzle to receive a gas from a source, the nozzle disposed on an arm a selected distance from an axis for rotation about the axis, the nozzle having an exit portion substantially perpendicular to the arm; and motive apparatus for rotating the arm whereby translational velocity of molecules in the gas is altered.

18. Apparatus for altering the translational velocity of molecules in a gas comprising:

a vacuum chamber;

a supersonic nozzle located within the vacuum chamber and to receive a gas from a source, the nozzle disposed on an arm a selected distance from an axis for rotation about the axis, the nozzle having an exit portion substantially perpendicular to the arm; and motive apparatus for rotating the arm whereby translational velocity of molecules in the gas is altered.

* * * * *